US009371832B2

(12) United States Patent
Kiem et al.

(10) Patent No.: US 9,371,832 B2
(45) Date of Patent: Jun. 21, 2016

(54) SCROLL COMPRESSOR

(75) Inventors: Myungkyun Kiem, Seoul (KR); Kyunghwan Kim, Seoul (KR); Ikseo Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 13/401,402

(22) Filed: Feb. 21, 2012

(65) Prior Publication Data

US 2013/0004354 A1 Jan. 3, 2013

(30) Foreign Application Priority Data

Jul. 1, 2011 (KR) ..... 10-2011-0065636

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F16N 13/20*** | (2006.01) |
| ***F04C 18/02*** | (2006.01) |

(52) U.S. Cl.

CPC ..... *F04C 18/0215* (2013.01); *F04C 18/0284* (2013.01); *F04C 2250/20* (2013.01); *F04C 2250/301* (2013.01)

(58) Field of Classification Search

CPC .. F01C 1/0246; F01C 1/0215; F04C 18/0215; F04C 18/0269; F04C 2250/102; F04C 23/008; F04C 18/0246; F04C 18/0261; F04C 18/0284; F04C 2250/20; F04C 2250/301; F25B 13/00; F25B 31/00

USPC ..... 418/55.1–55.6, 57, 83, 150, 181; 29/888.02; 62/324.1, 503; 417/310, 417/410.5

See application file for complete search history.

(56) References Cited

U.S. PATENT DOCUMENTS

| | | | | | |
|---|---|---|---|---|---|
| 4,303,379 | A | * | 12/1981 | Hiraga et al. | 418/55.2 |
| 4,475,360 | A | * | 10/1984 | Suefuji et al. | 62/324.1 |
| 5,425,626 | A | * | 6/1995 | Tojo et al. | 418/150 |
| 5,427,512 | A | * | 6/1995 | Kohsokabe et al. | 418/150 |
| 5,516,267 | A | * | 5/1996 | Ikeda et al. | 418/55.6 |
| 5,554,017 | A | * | 9/1996 | Kohsokabe et al. | 29/888.02 |
| 5,836,752 | A | * | 11/1998 | Calhoun et al. | 418/55.2 |
| 5,938,417 | A | | 8/1999 | Takao et al. | |

(Continued)

FOREIGN PATENT DOCUMENTS

| | | | |
|---|---|---|---|
| CN | 1074276 | A | 7/1993 |
| CN | 1086294 | A | 5/1994 |

(Continued)

OTHER PUBLICATIONS

JP-64-63680_English_Abstract obtained from Espacenet.com on Nov. 3, 2014.*

*Primary Examiner* — Jorge Pereiro
*Assistant Examiner* — Daniel Wagnitz
(74) *Attorney, Agent, or Firm* — Dentons US LLP

(57) ABSTRACT

A scroll compressor including a fixed scroll having a fixed wrap; and an orbiting scroll having an orbiting wrap engaged with the fixed wrap to form compression chambers, and performing an orbital motion with respect to the fixed scroll, wherein at least one of the fixed wrap and the orbiting wrap has a first constant section, a variable section, and a second constant section consecutively formed in a direction from a wrap final end to a wrap initial end.

16 Claims, 7 Drawing Sheets

(56) References Cited

U.S. PATENT DOCUMENTS

| | | | | |
|---|---|---|---|---|
| 7,789,640 | B2 * | 9/2010 | Uekawa | 418/55.3 |
| 8,246,331 | B2 * | 8/2012 | Uekawa | 418/55.3 |
| 2001/0006604 | A1 * | 7/2001 | Choi et al. | 418/55.2 |
| 2002/0071780 | A1 * | 6/2002 | Chang et al. | 418/55.2 |
| 2006/0057010 | A1 * | 3/2006 | Tsubono et al. | 418/55.5 |
| 2008/0159894 | A1 * | 7/2008 | Kanemoto | 418/55.2 |
| 2009/0074593 | A1 * | 3/2009 | Joo et al. | 417/310 |
| 2010/0209277 | A1 * | 8/2010 | Cho | 418/55.2 |
| 2011/0027115 | A1 * | 2/2011 | Oh et al. | 418/55.1 |
| 2012/0045357 | A1 * | 2/2012 | Huang | 418/55.2 |

FOREIGN PATENT DOCUMENTS

| | | | | | |
|---|---|---|---|---|---|
| CN | 1350121 | A | | 5/2002 | |
| CN | 1356475 | A | | 7/2002 | |
| CN | 1820144 | A | | 8/2006 | |
| CN | 101449061 | A | | 6/2009 | |
| JP | 64-63680 | A | * | 3/1989 | F04C 18/02 |
| JP | 2-264178 | A | | 10/1990 | |
| KR | 10-2002-0045004 | A | | 6/2002 | |
| KR | 10-2006-0020640 | A | | 3/2006 | |
| KR | 10-2006-0106870 | | | 10/2006 | |

* cited by examiner

SCROLL COMPRESSOR

CROSS-REFERENCE TO RELATED APPLICATION

This application claims the benefit of Korean Patent Application No. 10-2011-0065636, filed on Jul. 1, 2011, which is hereby incorporated by reference for all purposes as if fully set forth herein.

TECHNICAL FIELD

The present disclosure relates to a scroll compressor.

BACKGROUND

A scroll compressor generally comprises a compressor with a pair of compression chambers which consecutively move between a fixed wrap of a fixed scroll and an orbiting wrap of an orbiting scroll. When compared to other compressors, the scroll compressor exhibits excellent vibration and noise characteristics. This is because a refrigerant is alternately sucked into the two compression chambers, and then is consecutively compressed to be discharged.

A behavior characteristic of the scroll compressor is determined by the fixed wrap and the orbiting wrap designs. The fixed wrap and the orbiting wrap may be formed in any shape. However, each of the fixed wrap and the orbiting wrap is generally formed as an involute curve having a constant wrap thickness. An involute curve is a curve corresponding to an orbit formed by the end of a taut thread when unwinding the thread wound on a circle of any radius. When using the involute curve shape, a capacity change ratio is constant since a wrap thickness is constant. Therefore, to achieve a high compression ratio of the scroll compressor, the number of windings of the wrap has to be increased or the height of the wrap has to be increased. However, when the number of windings of the wrap is increased, the compressor's size may become too large. Furthermore, when the height of the wrap is increased, the intensity of the wrap is lowered and degrades reliability.

In order to solve these problems, the conventional scroll fluid machine (Japanese Patent Application Publication No. 6-137286) has disclosed a method capable of enhancing a compression ratio without increasing the number of windings of a wrap. This is accomplished by forming the wrap in an involute curve, where a wrap thickness becomes thicker by a predetermined ratio toward an inside initial end (discharge side end) from an outside terminal end (suction side end), or by forming a height of a discharge side end plate (i.e., wrap height) to be higher than a height of a suction side end plate, while maintaining a wrap thickness of a scroll. To design a wrap such that its thickness can be increased towards a discharge side end, the wrap thickness of a suction side end must first be determined. This may lower the degree of design freedom of the wrap, and thus may cause limitations in designing a compression ratio of the scroll compressor in accordance with a desired refrigerating capacity.

Furthermore, in the case of increasing a height of a discharge side end plate while constantly maintaining a wrap thickness of a scroll, a discharge side wrap intensity with respect to a compression ratio is low. This may cause damage to the wrap. Furthermore, since a sealing area with respect to a compression ratio is narrow due to a thin wrap thickness, leakage in an axial direction may also occur.

SUMMARY

Therefore, a scroll compressor capable of a reduced overall size while maintaining a sufficient compression ratio by enhancing the degrees of design freedom of a wrap is highly desirable.

Further, a scroll compressor capable of preventing wrap damages at a discharge side and leakage in an axial direction is also desirable.

To achieve these and other advantages and in accordance with the purpose of the present disclosure, as embodied and broadly described herein, there is provided a scroll compressor, comprising: a fixed scroll having a fixed wrap; and an orbiting scroll having an orbiting wrap engaged with the fixed wrap to form compression chambers, and performing an orbital motion with respect to the fixed scroll, wherein at least one of the fixed wrap and the orbiting wrap has a first constant section, a variable section, and a second constant section consecutively formed in a direction from a wrap final end P2 to a wrap initial end P1.

According to another embodiment of the present invention, there is provided a scroll compressor, comprising: a fixed scroll having a fixed wrap; and an orbiting scroll having an orbiting wrap engaged with the fixed wrap to form compression chambers, and performing an orbital motion with respect to the fixed scroll, wherein at least one of the fixed wrap and the orbiting wrap has at least two constant sections with a wrap constant thickness, including a first constant section positioned at a suction side, and a second constant section positioned at a discharge side, wherein a ratio ($a=t2/t1$) of a wrap thickness (t2) at the second constant section with respect to a wrap thickness (t1) at the first constant section is in the range of $1.5 \leq a \leq 3.0$.

According to still another embodiment of the present invention, there is provided a scroll compressor, comprising: a fixed scroll having a fixed wrap which forms an outside surface curve and an inside surface curve, at least one curve formed as two curves having the same basic circle center O', O" but different basic circle radiuses are combined to each other; and an orbiting scroll having an orbiting wrap which forms an outside surface curve and an inside surface curve, at least one curve formed as two curves having different basic circle radiuses are combined to each other, the orbiting wrap engaged with the fixed wrap to form compression chambers, and the orbiting scroll performing an orbital motion with respect to the fixed scroll, wherein at least one of the fixed wrap and the orbiting wrap comprise as outside surface first curve at a suction side of the outside surface curve, and an outside surface second curve at a discharge port side of the outside surface curve, wherein a starting point of the outside surface first curve is formed within the range of $\Phi e-(540\pm180)°$~a wrap terminal angle ($\Phi e$), and a starting point of the outside surface second curve is formed within the range of $\Phi e-(540\pm180)°$~0°, and wherein at least one of the fixed wrap and the orbiting wrap further comprise an inside surface first curve at a suction side of the inside surface curve, and an inside surface second curve at a discharge port side of the inside surface curve, wherein a starting point of the inside surface first curve is formed within the range of $\Phi e-(360\pm180)°$~a wrap terminal angle ($\Phi e$), and a starting point of the inside surface second curve is formed within the range of $\Phi e-(360\pm180)°$~0°.

BRIEF DESCRIPTION OF THE DRAWINGS

In the drawings:

FIGS. 7A-7D and 8A-8D are views illustrating processes for determining a shape of an orbiting wrap according to an embodiment of the present invention, in which FIG. 7A-7D are views illustrating profiles for determining an outside surface curve and FIG. 8A-8D are views illustrating profiles for determining an inside surface curve.

DETAILED DESCRIPTION OF THE DISCLOSURE

Reference will now be made in detail to the embodiments of the present invention, examples of which are illustrated in the accompanying drawings. It will also be apparent to those skilled in the art that various modifications and variations can be made without departing from the spirit or scope of the invention. Thus, it is intended that the modifications and variations are covered by the appended claims and their equivalents.

Description will now be given in detail of a scroll compressor according to an embodiment of the present invention, with reference to the accompanying drawings. For the sake of brief description with reference to the drawings, the same or equivalent components will be provided with the same reference numbers, and description thereof will not be repeated.

Figure 1:
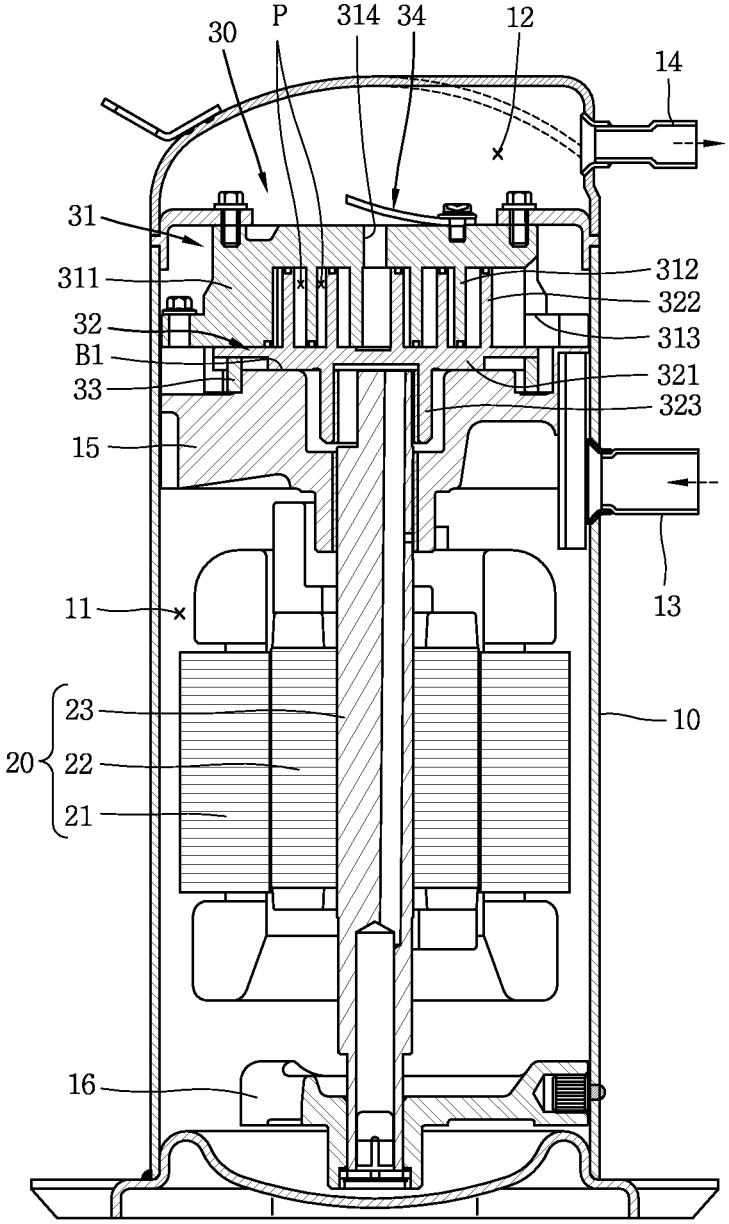
FIG. 1 is a sectional view illustrating an inner structure of a scroll compressor according to a first embodiment of the present invention.

FIG. 1 is a sectional view illustrating an inner structure of a scroll compressor according to a first embodiment of the present invention.

Referring to FIG. 1, a scroll compressor of the first embodiment comprises a shell 10 having a hermetic inner space. The hermetic inner space of shell 10 may be divided into a suction space 11 for filling a refrigerant of a suction pressure, and a discharge space 12 for filling a refrigerant of a discharge pressure. A suction pipe 13 is connected to suction space 11 of shell 10, for guiding a refrigerant to suction space 11. A discharge pipe 14 is connected to discharge space 12 of shell 10, for guiding a refrigerant discharged to discharge space 12 to a refrigerating cycle.

A driving motor 20 is fixedly installed at suction space 11 of shell 10. A coil may be wound on a stator 21 of driving motor 20 in a concentrated manner. Driving motor 20 may be implemented as a constant motor having the same rotation speed of a rotor 22. Alternatively, driving motor 20 may be implemented as an inverter motor having a variable rotation speed of rotor 22 with consideration of the multiple functions of a refrigerating apparatus to which the scroll compressor is applied. A crank shaft 23 of driving motor 20 is supported by a main frame 15 and a sub frame 16 fixedly-installed at upper and lower sides of shell 10.

A compression unit 30 is installed at one side of driving motor 20, for compressing a refrigerant sucked through suction pipe 13 at a pair of compression chambers (P) consecutively moving and formed by a fixed scroll 31 and an orbiting scroll 32 to be explained below, and for discharging the compressed refrigerant to discharge space 12 of shell 10.

Compression unit 30 includes (i) fixed scroll 31 coupled to main frame 15, (ii) orbiting scroll 32 engaged with fixed scroll 31 and forming a pair of compression chambers (P) which consecutively move, (iii) an Oldham's ring installed between orbiting scroll 32 and main frame 15 and inducing an orbital motion of orbiting scroll 32, and (iv) a check valve 34 installed to open and close a discharge port 314 of fixed scroll 31 and preventing backflow of discharge gas exhausted through discharge port 314.

Fixed scroll 31 is provided with an end plate 311 of a disc shape so as to be fixed to main frame 15, and a fixed wrap 312 for forming compression chambers (P). Fixed wrap 312 is formed on a bottom surface of end plate 311. A suction recess 313 is formed at the edge of end plate 311, and discharge port 314 is formed at a central part of end plate 311.

Orbiting scroll 32 is provided with an end plate 321 of a disc shape so as to perform an orbital motion between main frame 11 and fixed scroll 31, and an orbiting wrap 322 which forms the compression chambers (P) by being engaged with fixed wrap 312 is formed on an upper surface of end plate 321. A shaft accommodating portion 323 coupled to crank shaft 23 is protrudingly formed on a bottom surface of end plate 321.

An Oldham's ring 33 is installed between orbiting scroll 32 and main frame 15, and prevents orbiting scroll 32 from freely performing a rotation but allows orbiting scroll 32 to perform an orbital motion when receiving a rotation force of driving motor 20.

Once power is applied to driving motor 20, crank shaft 23 transmits a rotation force to orbiting scroll 32 for rotating together with rotor 22.

Then, orbiting scroll 32 performs the orbital motion on a thrust bearing surface (B1) of main frame 15 by Oldham's ring 33 by an eccentric distance. As a result, the pair of compression chambers (P) which consecutively move are formed between fixed wrap 312 and orbiting wrap 322.

Compression chambers (P) move toward the center by the continuous orbital motion of orbiting scroll 32, decreasing in volume. Accordingly, a refrigerant sucked into suction space 11 of shell 10 through suction pipe 13 is compressed, and then is discharged to discharge space 12 of shell 10 through discharge port 314 in communication with the final compression chamber.

The scroll compressor needs to perform a high compression ratio driving when being applied to a vehicle, for instance. That is, an air conditioner for a vehicle requires cooling and heating functions, and requires a high compression ratio driving at the time of a heating operation.

For a high compression ratio driving of the scroll compressor, a discharge volume has to be significantly smaller than a suction volume. However, a compression chamber volume is determined in advance when designing a wrap of the scroll compressor. This may cause a limitation in varying a compression chamber volume. In order to increase a compression chamber volume of the conventional scroll compressor, the number of windings of a wrap is increased, or a discharge side end plate height is set to be higher than a suction side end plate height. However, when the number of windings of a wrap is increased, the compressor's size may become too large. Furthermore, when a discharge side end plate height is set to be higher than a suction side end plate height, a wrap height is lowered. This may reinforce a wrap intensity. However, this may cause a wrap intensity in a horizontal direction with respect to an increased compression ratio not to be maintained, and may increase leakage in an axial direction due to a thin wrap thickness with respect to a compression ratio.

In order to solve these problems, a scroll compressor may have a logarithmic spiral structure in which a wrap thickness increases toward a discharge side end from a suction side end. This may implement a high compression ratio driving of a scroll compressor without increasing the number of windings of a wrap, and may enhance the reliability of the compressor by increasing a sealing area at a discharge side and the wrap intensity at a discharge side. However, the logarithmic spiral wrap limits the degree of design freedom, since a wrap thickness of a discharge side initial end is determined once a wrap thickness of a suction side terminal end is determined. This may cause limitations in significantly increasing or decreasing a compression ratio.

In one embodiment, a basic circle radius of a curve which forms a suction side end of a wrap (outside end portion or wrap terminal angle) is set to be different from a basic circle radius of a curve which forms a discharge side end of a wrap (inside end portion or wrap initial angle). This may allow a wrap thickness of a discharge side end to be variously designed even if a wrap thickness of a suction side end has been determined. As a result, a compression ratio of the compressor may be easily increased or decreased.

Figure 2:
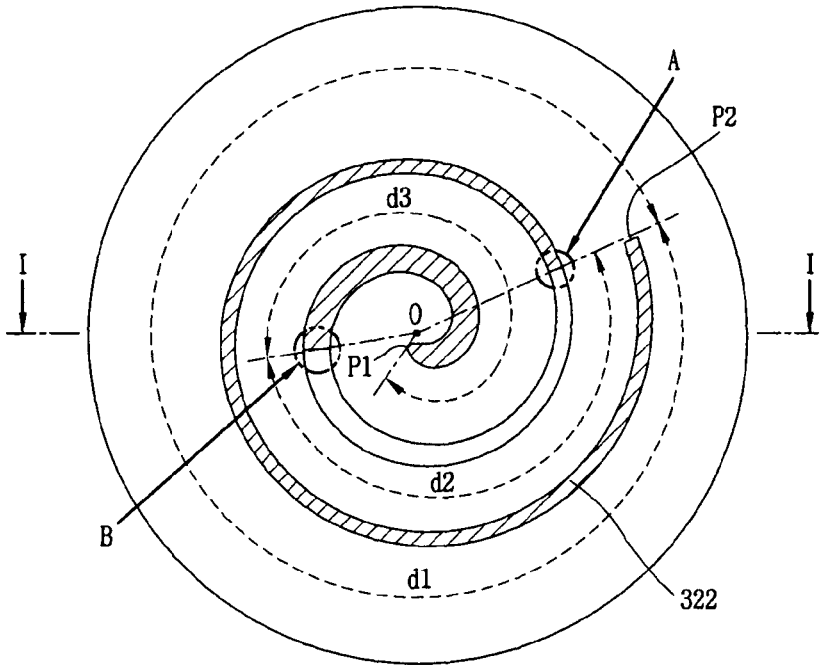
FIG. 2 is a planar view illustrating a thickness of an orbiting wrap according to an embodiment the present invention.
Figure 3:
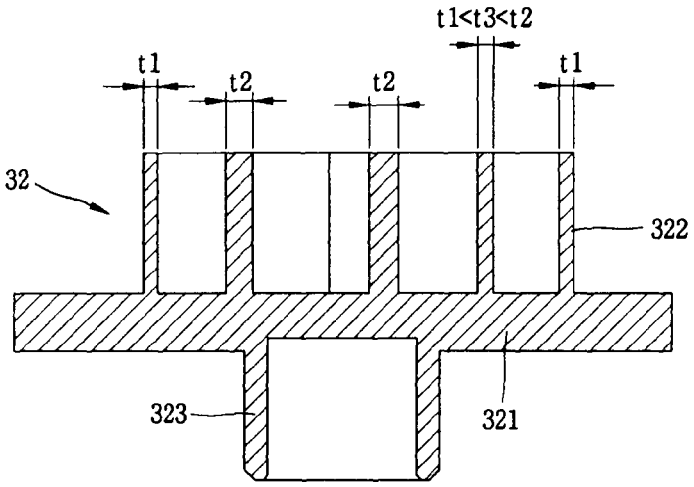
FIG. 3 is a sectional view taken along line 'I-I' in FIG. 2.

FIG. 2 is a planar view illustrating a thickness of an orbiting wrap according to an embodiment of the present invention, and FIG. 3 is a sectional view taken along line 'I-I' in FIG. 2. As an example, a fixed wrap and an orbiting wrap of this embodiment are formed to be symmetrical to each other, and the orbiting wrap will be explained as a representative example.

As shown in FIG. 2, orbiting wrap 322 has a first constant section (d1) from a suction side end (wrap terminal angle) to a predetermined section where a wrap thickness is constant, and has a variable section (d2) from an inside end of first constant section (d1) to a predetermined section where a wrap thickness is increased toward a discharge side. And, a second constant section (d3) where a wrap thickness is constant is formed from an inside end of variable section (d2) to a discharge side end (wrap initial angle).

A wrap thickness of first constant section (d1) is formed to be thinner than that of second constant section (d3). Referring now to FIG. 3, under an assumption that a wrap thickness at the first constant section (d1) is 't1' and a wrap thickness at the second constant section (d3) is 't2', a ratio (a=t2/t1) of the wrap thickness (t2) at second constant section (d3) with respect to the wrap thickness (t1) at first constant section (d1) is in the range of $1.5 \le a \le 3.0$. If the ratio (a=t2/t1) of wrap thickness (t2) at second constant section (d3) with respect to wrap thickness (t1) at first constant section (d1) is 1.5 or less, then a wrap thickness of a discharge side end is thinner than the conventional logarithmic shaped-orbiting wrap. This may cause a compression ratio not to increase to a desired degree. On the other hand, if the ratio (a=t2/t1) is 3.0 or more, then the wrap thickness at second constant section (d3) of a discharge port side is too thick. This may cause a difficulty in obtaining a discharge port. Furthermore, a decrease in the cross-sectional area of the discharge port increases a discharge resistance of the port. This may result in lower performance of the compressor.

The wrap thickness (t3) at the variable section has a minimum value equal to or more than wrap thickness (t1) at first constant section (d1), and has a maximum value equal to or less than wrap thickness (t2) at second constant section (d2).

Figure 4:
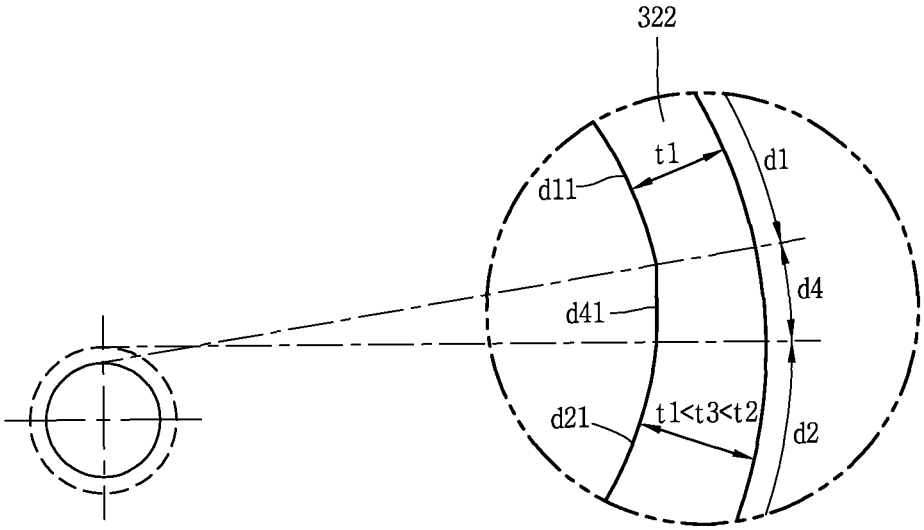
FIG. 4 is an enlarged planar view illustrating part of 'A' in FIG. 2.
Figure 5:
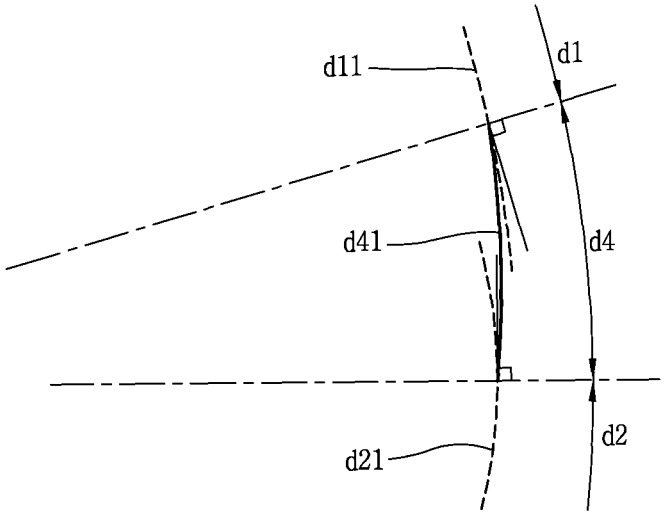
FIG. 5 is a schematic view illustrating a generating curve of a connection section in FIG. 4.
Figure 6:
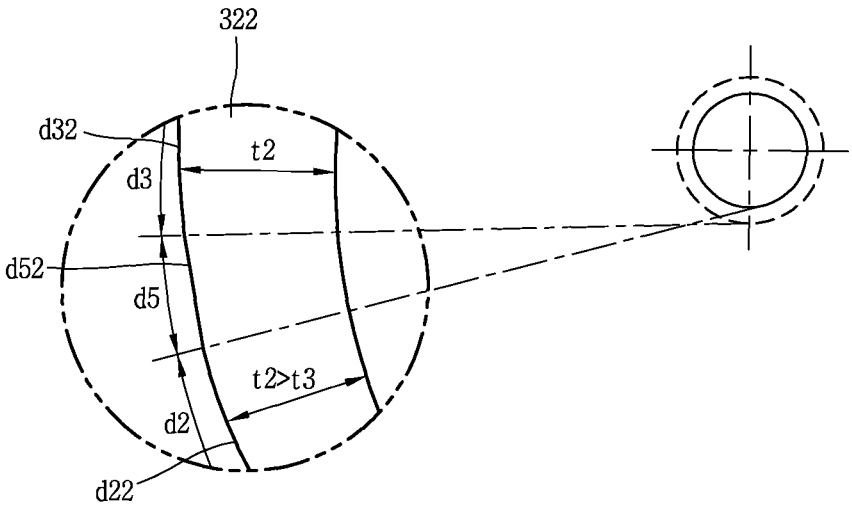
FIG. 6 is an enlarged planar view illustrating part of 'B' in FIG. 2.

FIG. 4 is an enlarged planar view illustrating part of 'A' in FIG. 2, FIG. 5 is a schematic view illustrating a generating curve of a connection section in FIG. 4, and FIG. 6 is an enlarged planar view illustrating part of 'B' in FIG. 2.

As shown in FIG. 4, an intersection region (d4) (i.e., first connection section) between first constant section (d1) and variable section (d2) may be implemented as a curve having a different curvature from first constant section (d1) or variable section (d2), or a straight line. As shown in FIG. 6, an intersection region (d5) (i.e., second connection section) between variable section (d2) and second constant section (d3) may be also implemented as a curve having a different curvature from variable section (d2) or second constant section (d3), or a straight line.

First connection section (d4) is formed at a position where an inside surface (d11) of first constant section (d1) meets an inside surface (d21) of variable section (d2), and an inside surface (d41) of first connection section (d4) may be formed by a generating curve. Here, the generating curve means an orbit formed by movements of a predetermined shape, which may be defined as a line contacting all points included in the two sections (d1 and d2).

As shown in FIG. 6, second connection section (d5) is formed at a position where an outside surface (d32) of second constant section (d3) meets an outside surface (d22) of variable section (d2), and an outside surface (d52) of second connection section (d5) may be also formed by a generating curve like inside surface (d41) of first connection section (d4).

First connection section (d4) may be formed at an outer side of second connection section (d5) based on the center of the orbiting scroll. That is, the center of first connection section (d4) may be formed to be closer to the end of a discharge side of the orbiting wrap, with a difference of a predetermined crank angle from the center of second connection section (d5). As a result, variable section (d2) is formed at the orbiting wrap 322, and an inside surface and an outside surface of variable section (d2) may have different curvatures.

FIGS. 7A-7D and 8A-8D are views illustrating processes for determining a shape of the orbiting wrap according to an embodiment of the present invention, in which FIG. 7A-7D are views illustrating profiles for determining an outside surface curve and FIG. 8A-8D are views illustrating profiles for determining an inside surface curve.

Each of an outside surface curve 3221 and an inside surface curve 3225 of orbiting wrap 322 in this embodiment is formed by combining curves having different basic circle radiuses to one another. The fixed wrap may be implemented in the same manner.

Figure 7:
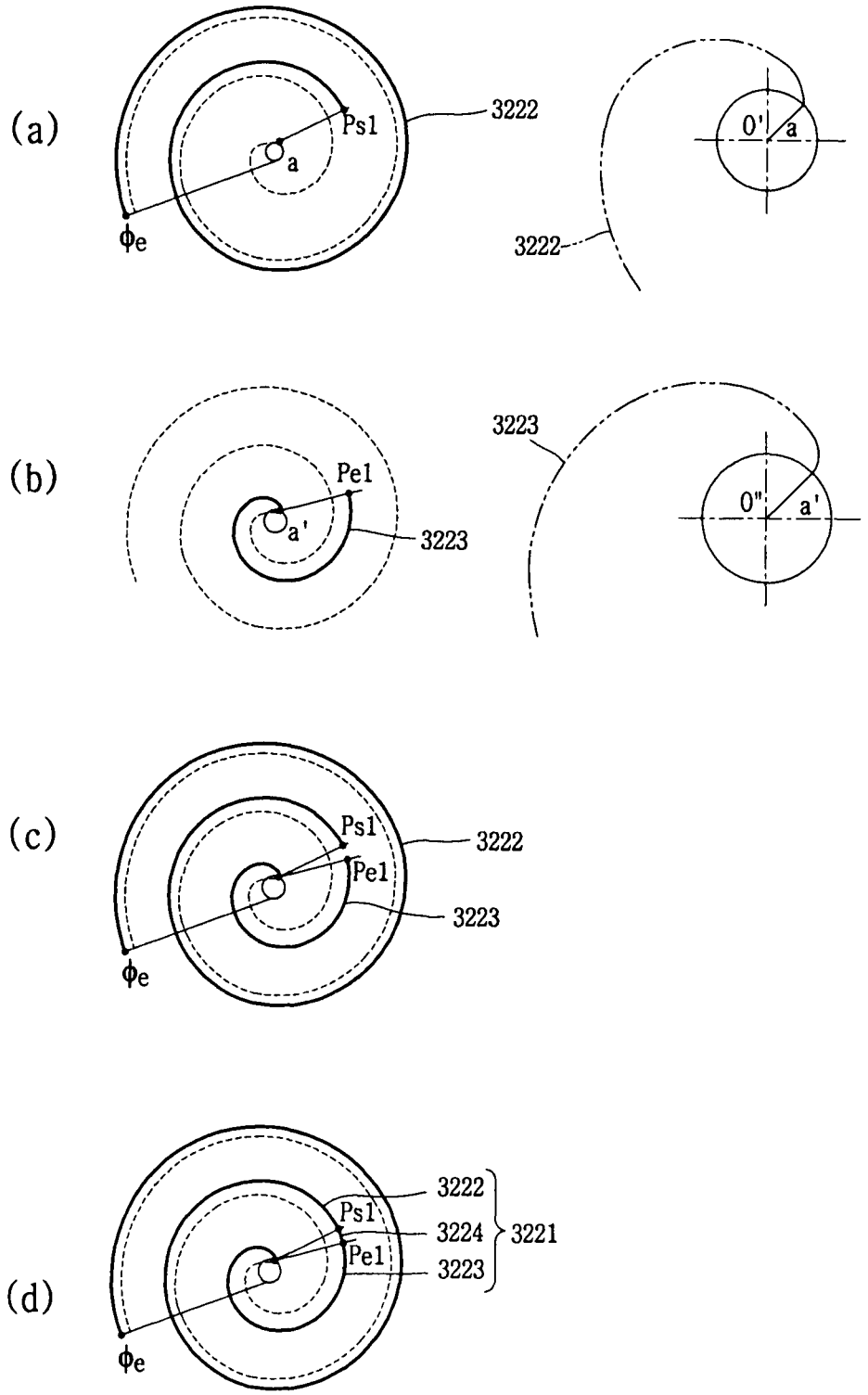
Figure 8:
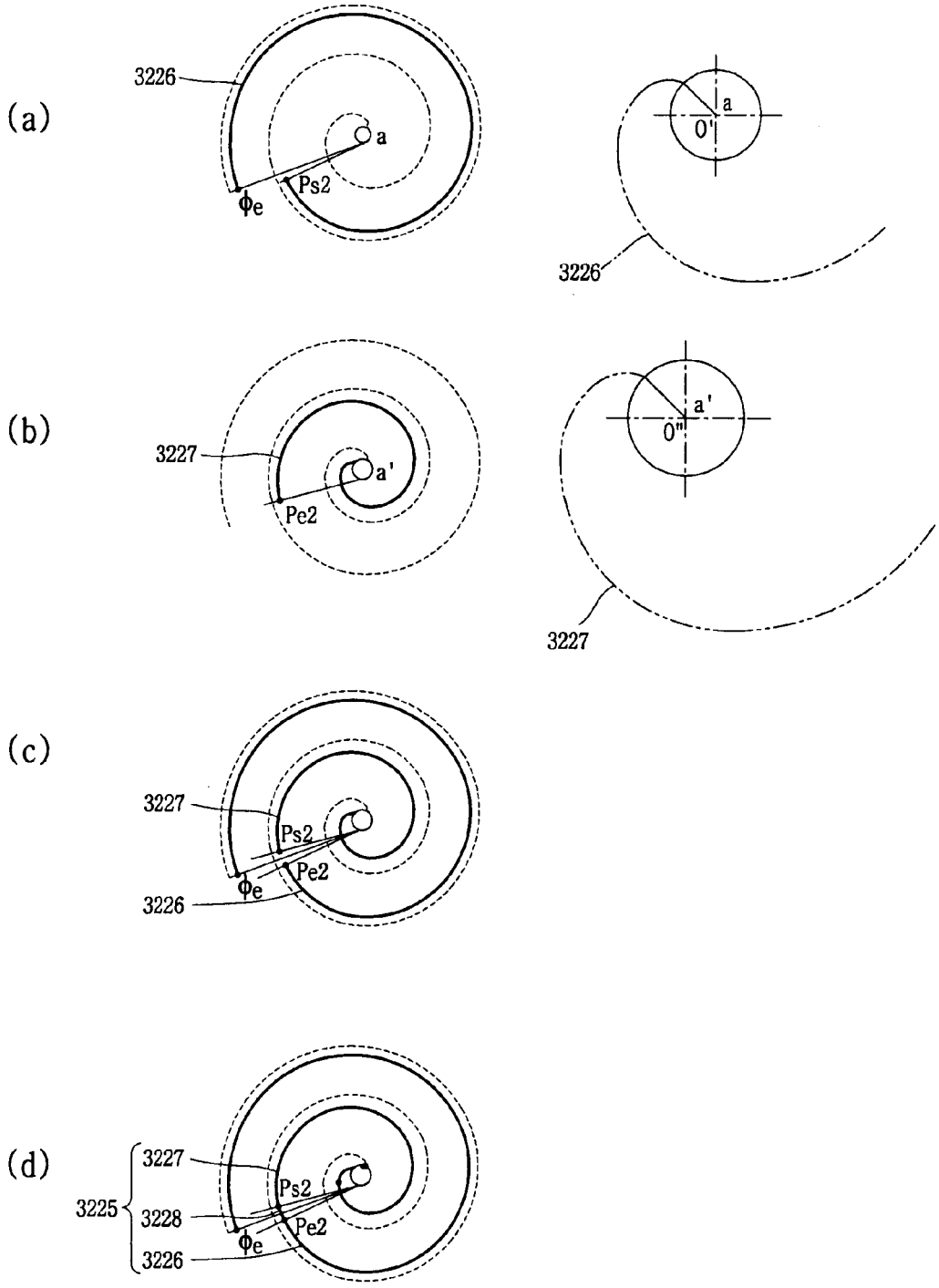

As an example, it is assumed that a suction side outside surface curve is referred to as 'outside surface first curve' 3222, and a discharge side outside surface curve is referred to as 'outside surface second curve' 3223. In this case, as shown in FIGS. 7A and 7B, a basic circle radius (a) of outside surface first curve 3222 is smaller than a basic circle radius (a') of outside surface second curve 3223. The dotted line of FIG. 7 indicates an inside surface curve, whereas the dotted line of FIG. 8 indicates an outside surface curve.

More specifically, as shown in FIG. 7A, a starting point (Ps1) of outside surface first curve 3222 is formed, as an involute curve, at a section from a wrap terminal angle (Φe) to a predetermined angle (Φe−(540±180°) (outside middle angle) in a discharge side direction. The alternate long and two short dashed line of the right side indicates a virtual line for drawing outside surface first curve 3222.

As shown in FIG. 7B, an ending point (Pe1) of outside surface second curve 3223 is formed at a section from outside middle angle (Φe−(540±180°)) to the wrap terminal angle (0°). Preferably, the starting point (Φs) of outside surface second curve 3223 starts from a point spacing from the outside middle angle toward a discharge side, by a predetermined crank angle difference, so as to have second connection section (d5). If ending point (Pe1) of the outside surface second curve 3223 directly starts from starting point (Ps1) of the outside surface first curve 3222 without second connection section (d5), a stair-step occurs at a contact point between outside surface first curve 3222 and outside surface second curve 3223 having different basic circle radiuses and different curvatures. This may cause leakage in a radius direction of the compression chambers. The alternate long and two short dashed line of the right side indicates a virtual line for drawing outside surface second curve 3223.

As shown in FIG. 7C, outside surface first curve 3222 and outside surface second curve 3223 are formed on the same plane. Here, starting point (Ps1) of outside surface first curve 3222 is spaced from ending point (Pe1) of outside surface second curve 3223 by a predetermined crank angle difference.

As shown in FIG. 7D, outside surface first curve 3222 and outside surface second curve 3223 are connected to each other by an outer generating curve 3224 formed by the method previously discussed with reference to FIG. 5. As a result, outside surface curve 3221 of orbiting wrap 322 is completed.

Hereinafter, inside surface curve 3225 of orbiting wrap 322 will be explained.

As an example, it is assumed that a suction side inside surface curve is referred to as 'inside surface first curve' 3226, and a discharge side inside surface curve is referred to as 'inside surface second curve' 3227. In this case, as shown in FIGS. 8A and 8B, a basic circle radius (a) of inside surface first curve 3226 is smaller than a basic circle radius (a') of inside surface second curve 3227.

More specifically, as shown in FIG. 8A, a starting point (Ps2) of inside surface first curve 3226 is formed at a section from a wrap terminal angle (Φe) to a predetermined angle in a discharge side direction (Φe−(360±180°) (inside middle angle). The alternate long and two short dashed line of the right side indicates a virtual line for drawing inside surface first curve 3226.

As shown in FIG. 8B, an ending point (Pe2) of inside surface second curve 3227 is formed at a section from inside middle angle (Φe−(360±180°) to a wrap initial angle (0°). Preferably, ending point (Pe2) of inside surface second curve 3227 starts from a point spaced from inside middle angle toward a suction side, by a predetermined crank angle difference, so as to have first connection section (d4). If ending point (Pe2) of inside surface second curve 3227 directly starts from starting point (Ps2) of inside surface first curve 3226 without first connection section (d4), a stair-step occurs at a contact point between inside surface first curve 3226 and inside surface second curve 3227 having different basic circle radiuses and different curvatures. This may cause leakage in a radius direction of the compression chambers. The alternate long and two short dashed line of the right side indicates a virtual line for drawing inside surface second curve 3227.

As shown in FIG. 8C, inside surface first curve 3226 and inside surface second curve 3227 are formed on the same plane. Here, starting point (Ps2) of inside surface first curve 3226 is spaced from ending point (Pe2) of inside surface second curve 3227 by a predetermined crank angle difference.

As shown in FIG. 8D, inside surface first curve 3226 and inside surface second curve 3227 are connected to each other by an inner generating curve 3228 formed by the method previously discussed with reference to FIG. 5. As a result, an inside surface curve 3225 of orbiting wrap 322 is completed.

Figure 9:
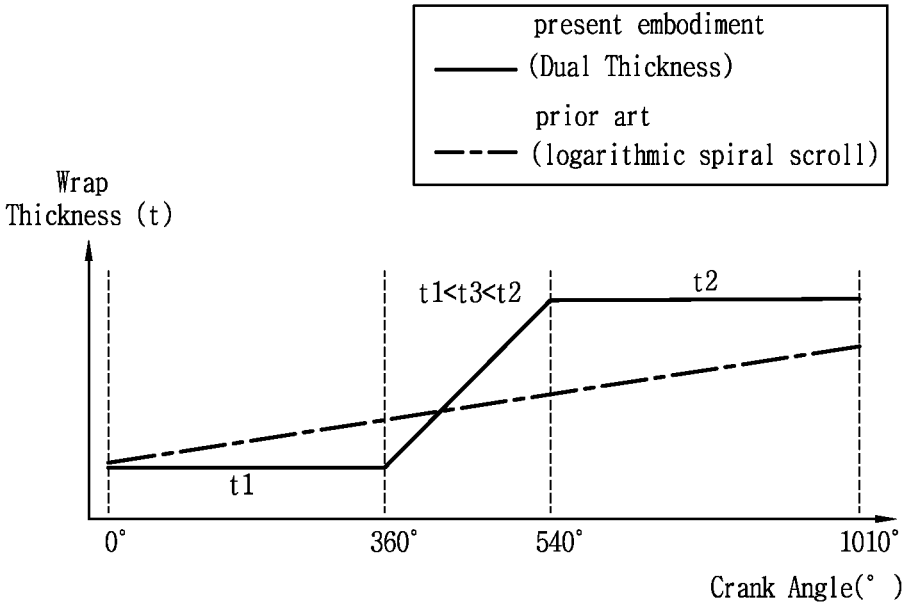
FIG. 9 is a graph comparing a wrap thickness of an orbiting wrap according to an embodiment of the present invention with a wrap thickness of the conventional logarithmic spiral orbiting wrap.

FIG. 9 is a graph comparing a wrap thickness of an orbiting wrap of the present invention with a wrap thickness of the conventional logarithmic shaped-orbiting wrap.

As shown, a wrap thickness of the orbiting wrap is different according to each section. Here, the sections included a first constant section, a variable section and a second constant section. The first constant section is formed within the range of a crank angle of 0~360°, the variable section is formed within the range of a crank angle of 360~540°, and the second constant section is formed within the range of a crank angle of 540~1010°.

On the other hand, a wrap thickness of the conventional logarithmic shaped-orbiting wrap uniformly increases within the range of a crank angle of 0°~1010°.

In the conventional logarithmic shaped-orbiting wrap, a wrap thickness of a discharge side end (near 1010°) is also determined once a wrap thickness of a suction side end (near (0°) is determined. This may cause a limitation in increasing the wrap thickness of the discharge side end under an assumption that the wrap thickness of the suction side end is the same as shown in FIG. 9.

The orbiting wrap according to one embodiment of the present invention may be compared with the conventional logarithmic shaped-orbiting wrap as follows. At the first constant section (0~360°), the wrap thickness is thinner than that of the conventional logarithmic spiral orbiting wrap. This may minimize a diameter of the scroll (or frame diameter). Furthermore, at the second constant section (540~1010°), the wrap thickness is significantly thicker than that of the conventional logarithmic spiral orbiting wrap. This may implement a high efficiency and a high intensity compression.

The fixed wrap is formed in the same manner as the orbiting wrap, and thus its detailed explanations will be omitted.

Under the aforementioned configurations, outside surface first curves of the fixed wrap and the orbiting wrap have a crank angle difference of 180° from inside surface first curves of the fixed wrap and the orbiting wrap. The outside surface first curves of the fixed wrap and the orbiting wrap may be formed to be longer than the inside surface first curves by 180°. Outside surface second curves of the fixed wrap and the orbiting wrap may be formed to be longer than inside surface second curves of the fixed wrap and the orbiting wrap by 180°. The fixed wrap and the orbiting wrap may have a variable section between the first constant section and the second constant section. Due to the variable section, the wrap thickness at the second constant section may be freely designed without any influences from the wrap thickness at the first constant section. This may allow a wrap thickness of a discharge side required to a high compression ratio scroll compressor to be obtained. Therefore, the scroll compressor may be widely applied to an air conditioner for a vehicle for heating and cooling.

In this embodiment, the scroll compressor is applied to a vertical low pressure type scroll compressor. However, the scroll compressor according to various embodiments of the present invention may be also applied to all types of scroll compressors including a high pressure type scroll compressor where a suction pipe is directly connected to compression chambers and a discharge pipe is communicated with an inner space of a shell, a horizontal type scroll compressor where a shell is disposed in a horizontal direction, etc.

The invention claimed is:

1. A scroll compressor, comprising:

a fixed scroll having a fixed wrap; and an orbiting scroll having an orbiting wrap engaged with the fixed wrap to form compression chambers, and the orbiting scroll performing an orbital motion with respect to the fixed scroll, wherein the fixed wrap and the orbiting wrap comprise a plurality of sections including a first constant section formed as an involute curve and with a wrap thickness that is constant in a lengthwise direction, a second constant section formed as an involute curve and with a wrap thickness that is constant in the lengthwise direction, and a variable section formed as a smooth transition curve between the first constant section and the second constant section and with a wrap thickness that increases in the lengthwise direction, wherein the first constant section, the variable section and the second constant section are consecutively formed in a direction from a wrap final end to a wrap initial end, wherein the first constant section is formed from the wrap final end to a predetermined crank angle, the variable section is formed from an end of the first constant section to a predetermined crank angle, and the second constant section is formed from an end of the variable section to the wrap initial end, wherein the wrap thickness of the first constant section is smaller than that of the second constant section, and wherein the wrap thickness of the variable section is continuously increased along an entire length of the variable section between the first constant section and the second constant section.

2. The scroll compressor of claim 1, wherein the fixed wrap and the orbiting wrap are formed by combining a plurality of curves originating at a center of a circle but extending out to different positions along the radius of the circle with respect to one another.

3. The scroll compressor of claim 1, wherein each of the fixed wrap and the orbiting wrap is formed as an involute curve originating at a center of a circle but extending out to different positions along the radius of the circle.

4. A scroll compressor, comprising:

a fixed scroll having a fixed wrap; and an orbiting scroll having an orbiting wrap engaged with the fixed wrap to form compression chambers, and configured to perform an orbital motion with respect to the fixed scroll, wherein each of the fixed wrap and the orbiting wrap has at least two constant sections with respective constant wrap thicknesses, including:

a first constant section positioned at a suction side, and a second constant section positioned at a discharge side, wherein a variable section, with a wrap thickness that is increased toward the second constant section, is disposed between the first constant section and the second constant section, wherein an outside surface of the variable section is formed as a first involute curve and an inside surface of the variable section is formed as a second involute curve, and wherein each of the first involute curve and the second involute curve is formed by separate respective involute curves originating at a center of a circle but extending out to different positions along the radius of the circle with respect to one another.

5. The scroll compressor of claim 4, wherein each of the fixed wrap and the orbiting wrap is formed by combining a plurality of curves originating at the center of the circle but extending out to different positions along the radius of the circle with respect to one another.

6. The scroll compressor of claim 4, wherein a minimum wrap thickness at the variable section is equal to the wrap thickness at the first constant section, and a maximum wrap thickness at the variable section is equal to the wrap thickness at the second constant section.

7. The scroll compressor of claim 4, wherein the fixed wrap and the orbiting wrap are formed as an involute curve originating at the center of the circle but extending out to different positions along the radius of the circle.

8. A scroll compressor, comprising:

a fixed scroll having a fixed wrap which forms an outside fixed scroll surface curve and an inside fixed scroll surface curve, at least one curve formed as two curves originating at a center of a circle but extending out to different positions along the radius of the circle with respect to one another; and an orbiting scroll having an orbiting wrap which forms an outside orbiting scroll surface curve and an inside orbiting scroll surface curve, at least one curve formed as two curves extending to different positions along the radius of the circle are combined to each other, the orbiting wrap engaged with the fixed wrap to form compression chambers, and the orbiting scroll performing an orbital motion with respect to the fixed scroll, wherein the fixed wrap and the orbiting wrap comprise:

an outside surface first curve at a suction side of an outside surface curve, and an outside surface second curve at a discharge port side of the outside surface curve, wherein the outside surface first curve is formed from a wrap terminal angle ($\Phi e$) to one point A, wherein the outside surface second curve is formed from the one point A to 0°, and wherein the one point A is in a crank angle of $\Phi e-(540\pm180)°$, and wherein the fixed wrap and the orbiting wrap further comprise:

an inside surface first curve at a suction side of an inside surface curve, and an inside surface second curve at a discharge port side of an inside surface curve, and wherein the inner surface first curve is formed from a wrap terminal angle ($\Phi e$) to another point B, wherein the inner side surface second curve is formed from the another point B to 0°, and wherein the another point B is in a crank angle of ($\Phi e-(360\pm180°)$), wherein the fixed wrap and the orbiting wrap have a first constant section, a variable section, and a second constant section consecutively formed in a direction from a wrap final end to a wrap initial end, a wrap thickness of the first constant section is smaller than that of the second constant section, and a wrap thickness of the variable section is continuously increased along an entire length of the variable section between the first constant section and the second constant section, and wherein an outside surface curve of the variable section is formed as the same involute curve which forms an outside surface of the first constant section, and an inside surface curve of the variable section is formed as the same involute curve as the involute curve which forms an inside surface of the second constant section.

9. The scroll compressor of claim 8, wherein a radius position of the outside surface first curve is smaller than that of the outside surface second curve, a radius position of the outside surface first curve is equal to that of the inside surface first curve, and a radius position of the outside surface second curve is equal to that of the inside surface second curve.

10. The scroll compressor of claim 8, wherein the outside surface first curve is longer than the inside surface first curve.

11. The scroll compressor of claim 8, wherein the outside surface second curve is longer than the inside surface second curve.

12. The scroll compressor of claim 8, wherein the starting point of the outside surface first curve has a crank angle difference of 180° from the starting point of the inside surface first curve.

13. The scroll compressor of claim 8, wherein the starting point of the outside surface second curve has a crank angle difference of 180° from the starting point of the inside surface second curve.

14. The scroll compressor of claim 8, wherein the fixed wrap and the orbiting wrap have the same length.

15. The scroll compressor of claim 8, wherein one of the fixed wrap and the orbiting wrap is longer than the other by 180°.

16. The scroll compressor of claim 8, wherein an intersection region between the outside surface first curve and the outside surface second curve, and an intersection region between the inside surface first curve and the inside surface second curve comprise curves having curvatures that are different from a curvature of the outside surface first curve, outside surface second curve, inside surface first curve, or inside surface second curve.

* * * * *